US008033405B2

(12) United States Patent
Wang

(10) Patent No.: US 8,033,405 B2
(45) Date of Patent: Oct. 11, 2011

(54) CLOSET ORGANIZER

(76) Inventor: Wen-Tsan Wang, Taipei (TW)

( * ) Notice: Subject to any disclaimer, the term of this patent is extended or adjusted under 35 U.S.C. 154(b) by 239 days.

(21) Appl. No.: 12/344,591

(22) Filed: Dec. 29, 2008

(65) Prior Publication Data

US 2010/0163505 A1 Jul. 1, 2010

(51) Int. Cl.
*A47F 5/08* (2006.01)

(52) U.S. Cl. ..... 211/118

(58) Field of Classification Search ..... 211/134, 211/186, 118, 113, 85.3, 36, 38, 90.01, 90.04, 211/117, 31, 149, 188; 229/120.06, 120.24, 229/120.26, 120.29, 120.31, 120.32, 120.38
See application file for complete search history.

(56) References Cited

U.S. PATENT DOCUMENTS 2,728,482 A * 12/1955 Driver ..... 220/534
3,079,040 A * 2/1963 Vesak ..... 206/166
3,201,022 A * 8/1965 Glassco et al. ..... 229/120.24
3,822,785 A * 7/1974 Getz et al. ..... 206/422
5,624,032 A * 4/1997 Yucknut et al. ..... 206/433
5,775,496 A * 7/1998 Cyr ..... 206/316.1
5,842,571 A * 12/1998 Rausch ..... 206/549
5,967,406 A * 10/1999 Moorman ..... 229/120.37
6,318,822 B1 * 11/2001 Wang ..... 312/111
6,640,944 B2 * 11/2003 Adams ..... 190/110
6,719,157 B2 * 4/2004 Stoddart et al. ..... 211/118
6,732,659 B2 * 5/2004 Poon ..... 108/42
2003/0111434 A1 * 6/2003 Stoddart et al. ..... 211/118
2004/0251795 A1 * 12/2004 Wang ..... 312/6
2007/0163977 A1 * 7/2007 Wang ..... 211/118
2007/0200470 A1 * 8/2007 Wang ..... 312/6

* cited by examiner

*Primary Examiner* — Darnell Jayne
*Assistant Examiner* — Patrick Hawn
(74) *Attorney, Agent, or Firm* — Leong C. Lei

(57) ABSTRACT

A closet organizer includes a shelf that has horizontal partition panels fixedly connected between two vertical side panels thereof to divide the internal space of the shelf into multiple vertically spaced receiving spaces, and ㄴ-shaped, ㄱ-shaped and L-shaped partition members selectively mounted in the receiving spaces to divide each receiving space into multiple compartments, and hook and loop materials respectively provided at the top and bottom sides of the horizontal partition panels and the ㄴ-shaped, ㄱ-shaped and L-shaped partition members for enabling the ㄴ-shaped, ㄱ-shaped and L-shaped partition members to be detachably secured to the two vertical side panels horizontal partition panels of the shelf.

1 Claim, 17 Drawing Sheets

CLOSET ORGANIZER

BACKGROUND OF THE INVENTION (a) Technical Field of the Invention

The present invention relates to organizers and more particularly, to a closet organizer, which has partition members mounted therein to divide the holding space into multiple compartments and, which can be directly collapsed without moving the internal partition members.

(b) Description of the Prior Art

For making efficient use of limited home space, close organizers may be hung in a wardrobe or on a door panel to keep different items. A collapsible closet organizer normally comprises two vertical side panels made of a flexible sheet material, a vertical back panel connected between the two vertical side panels at the back side, and a plurality of horizontal partition panels connected between the two vertical side panels at different elevations and dividing the holding space of the closet organizer into multiple vertically spaced receiving spaces. Further, partition boards may be inserted into the receiving spaces to divide each receiving space into multiple compartments. The partition boards are hardboards made of plastics, wood, metal, or any of a variety of other hard materials. If the closet organizer is not in use and to be received in a storage space, it cannot be directly collapsed. When directly collapsing the closet organizer, the partition boards will hinder the collapsing operation. Therefore, the user must take the partition boards out of the closet organizer when wishing to collapse the closet organizer.

SUMMARY OF THE INVENTION

The primary purpose of the present invention is to provide a closet organizer, which can be directly collapsed without moving the internal partition members out of the shelf thereof.

It is another object of the present invention to provide a closet organizer, which allows change of each receiving space defined in the shelf between two horizontal partition panels into different forms of compartments for storing classified items.

To achieve these and other objects of the present invention, a closet organizer comprises a shelf, and a plurality of partition members. The shelf comprises two vertical side panels arranged in parallel at two opposite lateral sides, a vertical back panel connected between the two vertical side panels at the back side, and a plurality of horizontal partition panels fixedly connected between the two vertical side panels at different elevations and dividing the holding space surrounded by the two vertical side panels and the vertical back panel into multiple vertically spaced receiving spaces. The partition members are mounted in the receiving spaces in the shelf to divide each receiving space into multiple compartments. The partition members are foldable relative to the shelf so that the shelf can be directly folded into a collapsed flat manner without removing the partition members.

Further, each partition member can be formed of one or a plurality of hardboards and wrapped with a flexible fabric covering so that the hardboards are foldable relative to one another.

Further, the partition members include ㄴ-shaped, ㄱ-shaped and L-shaped partition members selectively arranged in the receiving spaces in the shelf to divide each receiving space into multiple compartments.

Further, each ㄴ-shaped partition member comprises two side boards, an intermediate board, two first folding lines respectively connected between the two side boards and two opposite side edges of the intermediate board, two connection flanges respectively extended from the distal end of each side board remote from the intermediate board, and a second folding line formed in one side board in parallel to the first folding lines to make the respective side board foldable.

Further, each ㄴ-shaped partition member can be installed in one receiving space in the shelf in such a manner that the two second fastening devices of the ㄴ-shaped partition member are respectively fastened to the top side of the horizontal partition panel at the bottom side of the receiving space and the bottom side of the horizontal partition panel at the top side of the receiving space, and the first and second side boards are respectively attached to the two vertical side panels of the shelf to support the intermediate board in horizontal, thereby dividing the receiving space into two vertically spaced compartments.

Further, each ㄴ-shaped partition member can be installed in one receiving space in the shelf in such a manner that the two second fastening devices of the ㄴ-shaped partition member are respectively fastened to the top side of the horizontal partition panel at the bottom side of the receiving space and the bottom side of the horizontal partition panel at the top side of the receiving space, the first side board is attached to the top side of the horizontal partition panel at the bottom side of the receiving space, the intermediate board is obliquely stopped between the horizontal partition panel at the bottom side of the receiving space and one side panel of the shelf, and the second side board is kept in a double-beveled condition and suspending in the receiving space, and therefore the ㄴ-shaped partition member divides the receiving space into three different sizes of compartments.

Further, each ㄴ-shaped partition member can be installed in one receiving space in the shelf in such a manner that the two connection flanges of the ㄴ-shaped partition member are respectively fastened to the top side of the horizontal partition panel at the bottom side of the receiving space and the bottom side of the horizontal partition panel at the top side of the receiving space, the first side board is attached to the top side of the horizontal partition panel at the bottom side of the receiving space, the second side board is bent, by means of the second folding line, into right angles to have one part of the second side board be closely attached to the bottom side of the partition panel at the top side of the receiving space and the other part of the second side board be kept with the intermediate board in vertical to divide the receiving space into two equal compartments that are disposed side by side.

Further, four L-shaped partition members and one rectangular box-like partition member, which has its four sides respectively connected to one another by a respective folding line, can be mounted in one receiving space defined between two horizontal partition panels of the shelf, dividing the receiving space into 9 horizontally vertically aligned compartments.

Further, two ㄱ-shaped partition members can be reversely horizontally mounted in one receiving space in the shelf with the two side walls of each ㄱ-shaped partition member respectively attached to the two vertical side panels of the shelf, dividing the receiving space into three vertically spaced compartments.

Further, hook and loop materials are respectively provided at the top and bottom sides of the horizontal partition panels of the shelf and the partition members so that the partition members can be detachably fastened to the inside of the shelf to divide each receiving space into multiple compartments.

Further, the partition members can be fixedly fastened to the inside of the shelf with stitches.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
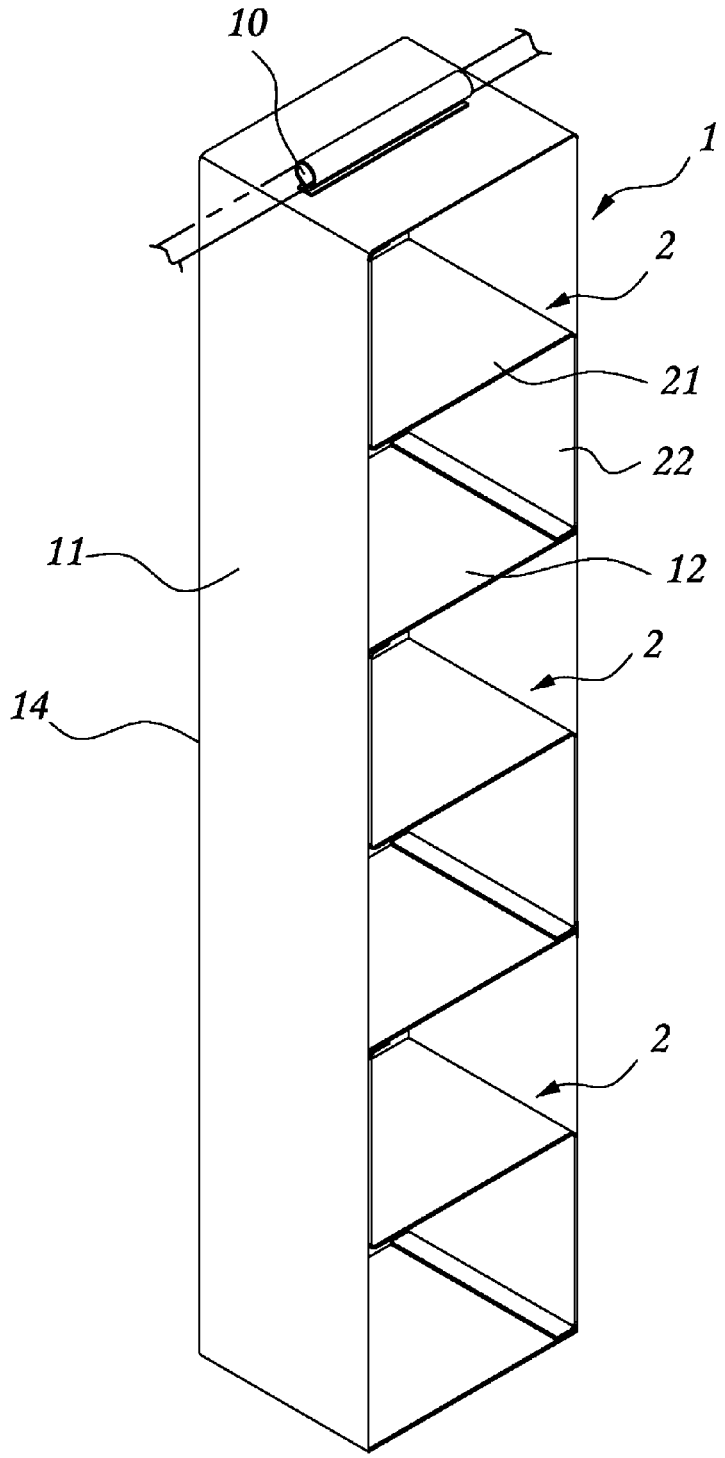
FIG. 1 is an elevational view of a closet organizer constructed in accordance with the present invention.

Referring to FIG. 1, a closet organizer in accordance with the present invention includes a shelf 1, and a plurality of ㄴ-shaped partition members 2 mounted in the shelf 1.

The shelf 1 comprises two vertical side panels 11 arranged in parallel at two opposite lateral sides, a vertical back panel 14 connected between the side panels 11 at the back side, a plurality of horizontal partition panels 12 fixedly connected between the two vertical side panels 11 at different elevations and dividing the holding space surrounded by the two vertical side panels 11 and the vertical back panel 14 into multiple vertically spaced receiving spaces, and a horizontal hanging hole 10 disposed at the top side for coupling to suspension means, for example, a hanging rod in a wardrobe. The vertical side panels 11, the horizontal partition panels 12 and the vertical back panel 14 are made of flexible fabrics and fixedly fastened together with stitches.

Figure 2:
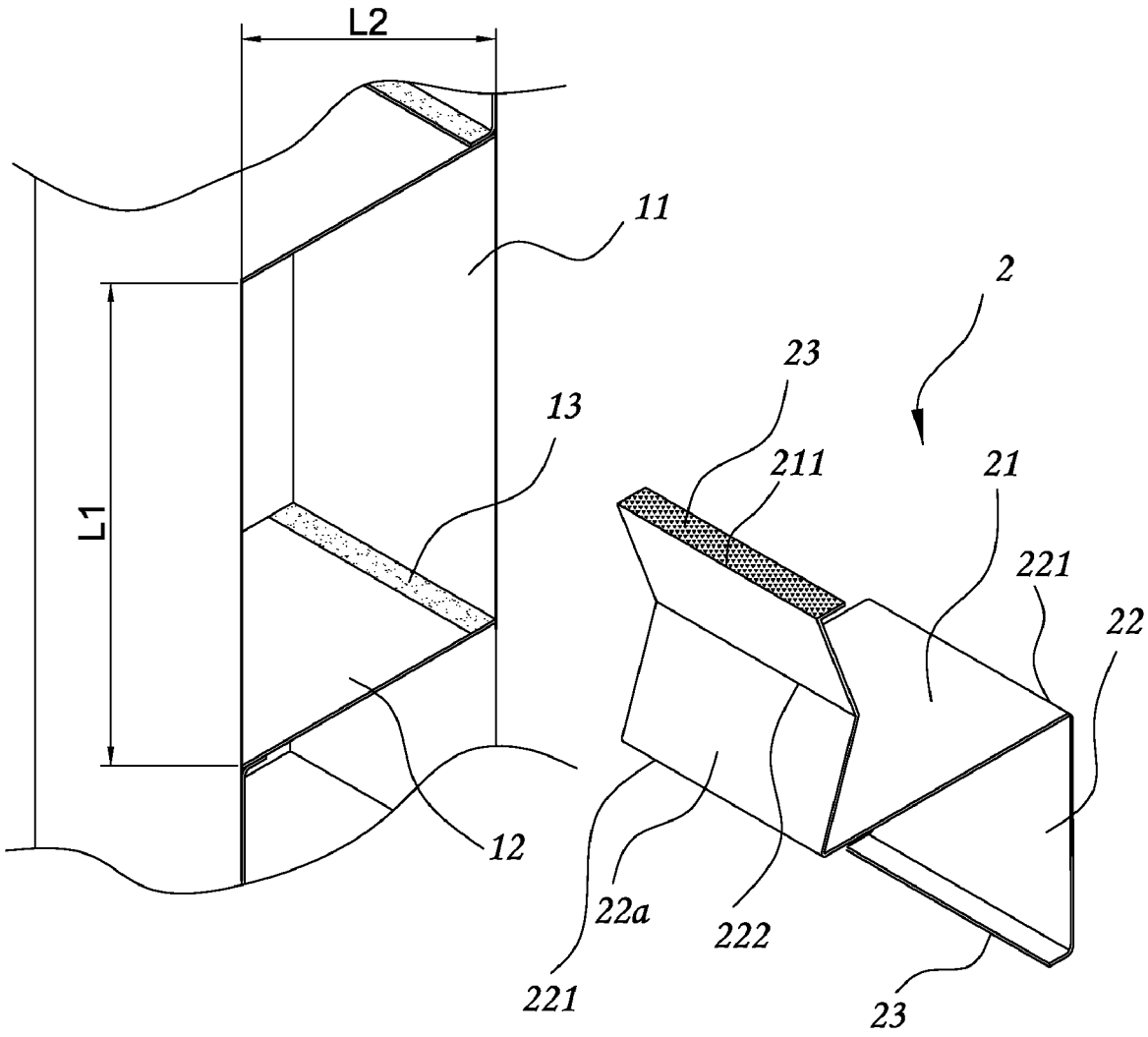
FIG. 2 is an exploded view of a part of the present invention, showing the structure of a ㄴ-shaped partition member for installation in one rectangular receiving space in the shelf of the closet organizer according to the present invention.

The ㄴ-shaped partition members 2 can be made in two different forms, one for installation in each rectangular receiving space defined in the shelf 1 and the other for installation in each square receiving space defined in the shelf 1. Each ㄴ-shaped partition member 2 of the first form for installation in a rectangular receiving space, as shown in FIG. 2, comprises a first side board 22, a second side board 22*a*, an intermediate board 21, two first folding lines (hinges) 221 respectively connected between the first side board 22 and second side board 22*a* and the two opposite side edges of the intermediate board 21, two connection flanges 211 respectively extended from the free ends of the first side board 22 and second side board 22*a* remote from the intermediate board 21, and a second folding line (hinge) 222 formed in the second side board 22*a* in parallel to the first folding lines (hinges) 221. Further, first fastening devices 13 are respectively provided at top and bottom sides of each horizontal partition panel 12 of the shelf 1 at selected locations, and second fastening devices 23 are respectively provided at the connection flanges 211 of each ㄴ-shaped partition member 2 of the first form and detachably fastened to the first fastening devices 13 (see FIG. 3). The first fastening devices 13 can be a hook material having hooks therein, and the second fastening devices 23 can be a loop material having loops therein for detachably securing the hooks of the hook material of the first fastening devices 13. Alternatively, the first fastening devices 13 can be a loop material having loops therein, and the second fastening devices 23 can be a hook material having hooks therein for detachably securing the loops of the loop material of the first fastening devices 13. Further, the distance between the second folding line 222 and the first folding line 221 in between the intermediate board 21 and the first side board 22 is equal to the length L1 of each long side of each rectangular receiving space defined in the shelf 1 (see FIG. 2). The distance between the two first folding lines 221 is equal to the length L2 of each short side of each rectangular receiving space defined in the shelf 1 (see FIG. 2).

Figure 3:
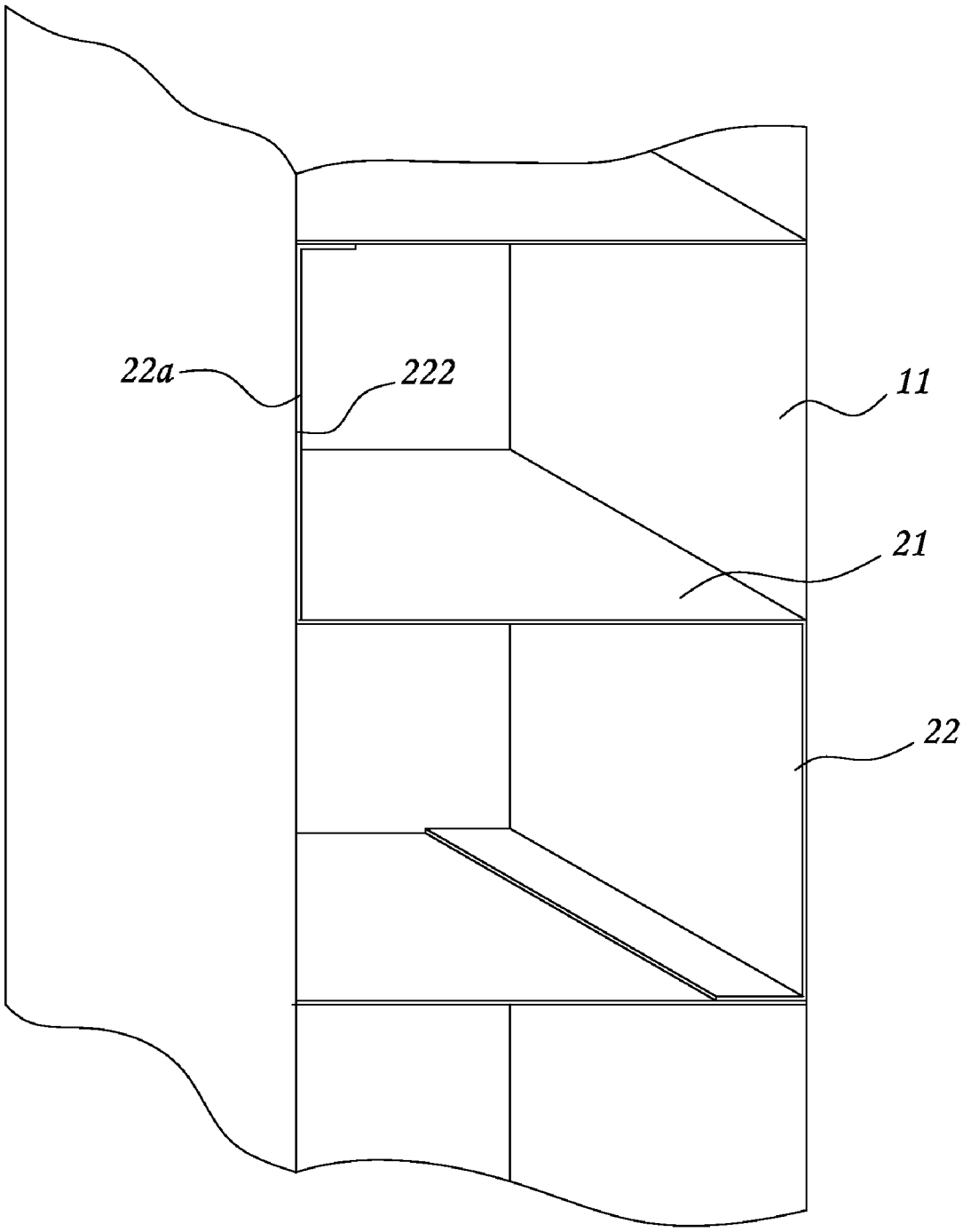
FIG. 3 illustrates one installation example of one ㄴ-shaped partition member in one rectangular receiving space in the shelf of the closet organizer according to the present invention.
Figure 4:
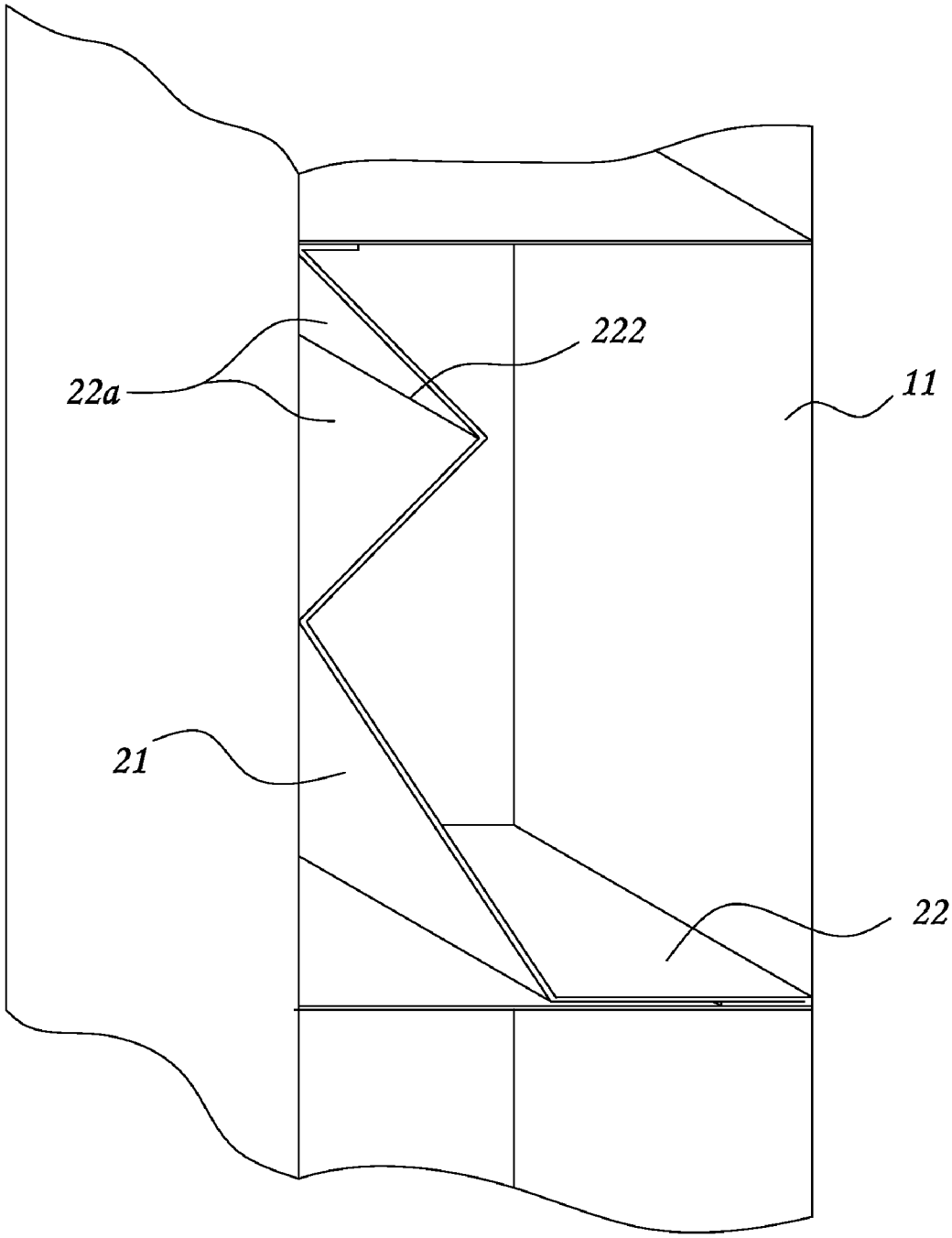
FIG. 4 illustrates another installation example of one ㄴ-shaped partition member in one rectangular receiving space in the shelf of the closet organizer according to the present invention.
Figure 5:
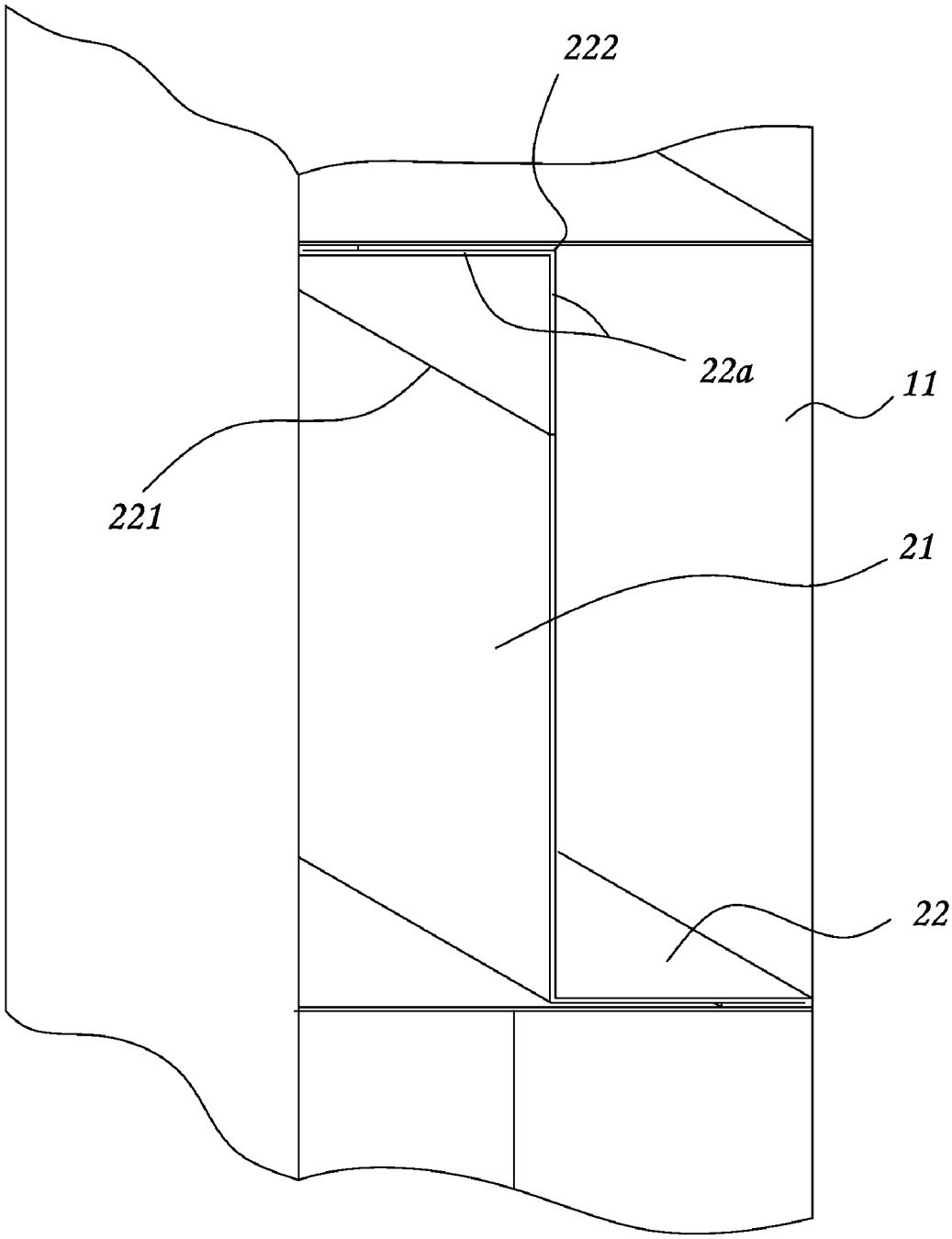
FIG. 5 illustrates still another installation example of one ㄴ-shaped partition member in one rectangular receiving space in the shelf of the closet organizer according to the present invention.

When installing one ㄴ-shaped partition member 2 in one rectangular receiving space defined in the shelf 1, it can be done in any of three ways respectively shown in FIGS. 3, 4 and 5. According to the installation method shown in FIG. 3, the two second fastening devices 23 of the ㄴ-shaped partition member 2 are respectively fastened to one first fastening device 13 at the top side of the horizontal partition panel 12 that is disposed at the bottom side of the rectangular receiving space and one first fastening device 13 at the bottom side of the horizontal partition panel 12 that is disposed at the top side of the rectangular receiving space, and the first and second side boards 22 and 22*a* are respectively attached to the two vertical side panels 11 of the shelf 1 to support the intermediate board 21 in horizontal, thereby dividing the respective rectangular receiving space into two vertically spaced compartments. According to the installation method shown in FIG. 4, the two second fastening devices 23 of the ㄴ-shaped partition member 2 are respectively fastened to one first fastening device 13 at the top side of the horizontal partition panel 12 that is disposed at the bottom side of the rectangular receiving space and one first fastening device 13 at the bottom side of the horizontal partition panel 12 that is disposed at the top side of the rectangular receiving space, the first side board 22 is attached to the top side of the horizontal partition panel 12 that is disposed at the bottom side of the rectangular receiving space, the intermediate board 21 is obliquely stopped between the horizontal partition panel 12 that is disposed at the bottom side of the rectangular receiving space and one side panel 11 of the shelf 1, and the second side board 22*a* is kept in a double-beveled condition and suspending in the rectangular receiving space, and therefore the ㄴ-shaped partition member 2 divides the rectangular receiving space into three different sizes of compartments. According to the installation method shown in FIG. 5, the two second fastening devices 23 of the ㄴ-shaped partition member 2 are respectively fastened to one first fastening device 13 at the top side of the horizontal partition panel 12 that is disposed at the bottom side of the rectangular receiving space and one first fastening device 13 at the bottom side of the horizontal partition panel 12 that is disposed at the top side of the rectangular receiving space, the first side board 22 is attached to the top side of the horizontal partition panel 12 that is disposed at the bottom side of the rectangular receiving space, the second side board 22*a* is bent, by means of the second folding line 22, into right angles to have one pail of the second side board 22*a* be closely attached to the bottom side of the partition panel 12 that is disposed at the top side of the rectangular receiving space and the other part of the second side board 22*a* be kept with the intermediate board 21 in vertical to divide the rectangular receiving space into two equal compartments that are disposed side by side.

Further, the ㄴ-shaped partition members 2 are preferably made by wrapping four hardboards with a flexible fabric, so that the hardboards form with the flexible fabric the first and second side boards 22 and 22*a* and the intermediate board 21, and the gaps between each two adjacent hardboards form with the flexible fabric the respective folding lines 221 and 222.

Figure 6:
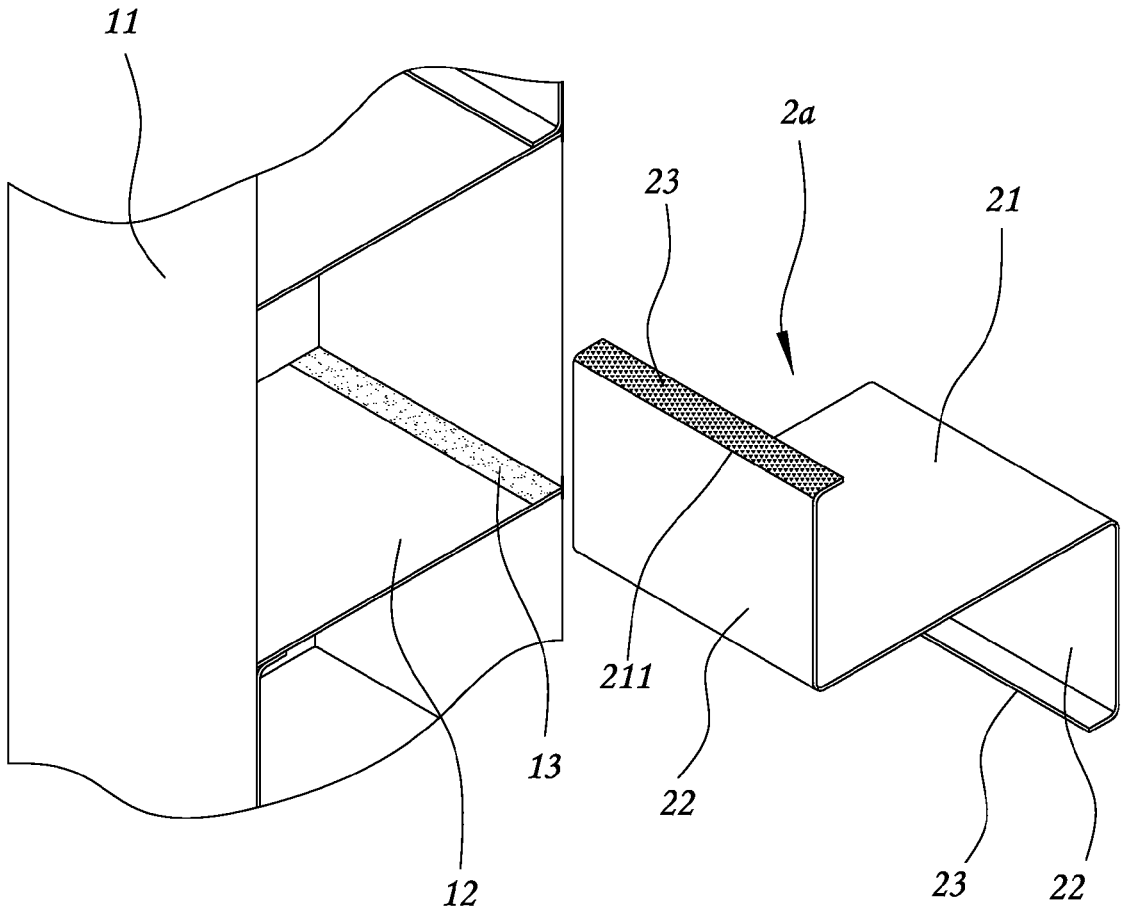
FIG. 6 is an exploded view of a part of the present invention, showing the structure of one ㄴ-shaped partition member for installation in one square receiving space in the shelf of the closet organizer according to the present invention.

Further, each ㄴ-shaped partition member 2 of the second form for installation in a square receiving space, as shown in FIG. 6, comprises two side boards 22, an intermediate board 21 connected between the two side boards 22, two connection flanges 211 respectively extended from the free ends of the side boards 22 remote from the intermediate board 21, and two folding lines (hinges) 221 respectively connected between the intermediate board 21 and the side boards 22. Further, first fastening devices 13 are respectively provided at top and bottom sides of each horizontal transverse panels 12 of the shelf 1 at selected locations, and second fastening devices 23 are respectively provided at the connection flanges 211 of each ㄴ-shaped partition member 2*a* of the second form and detachably fastened to the first fastening devices 13.

Figure 7:
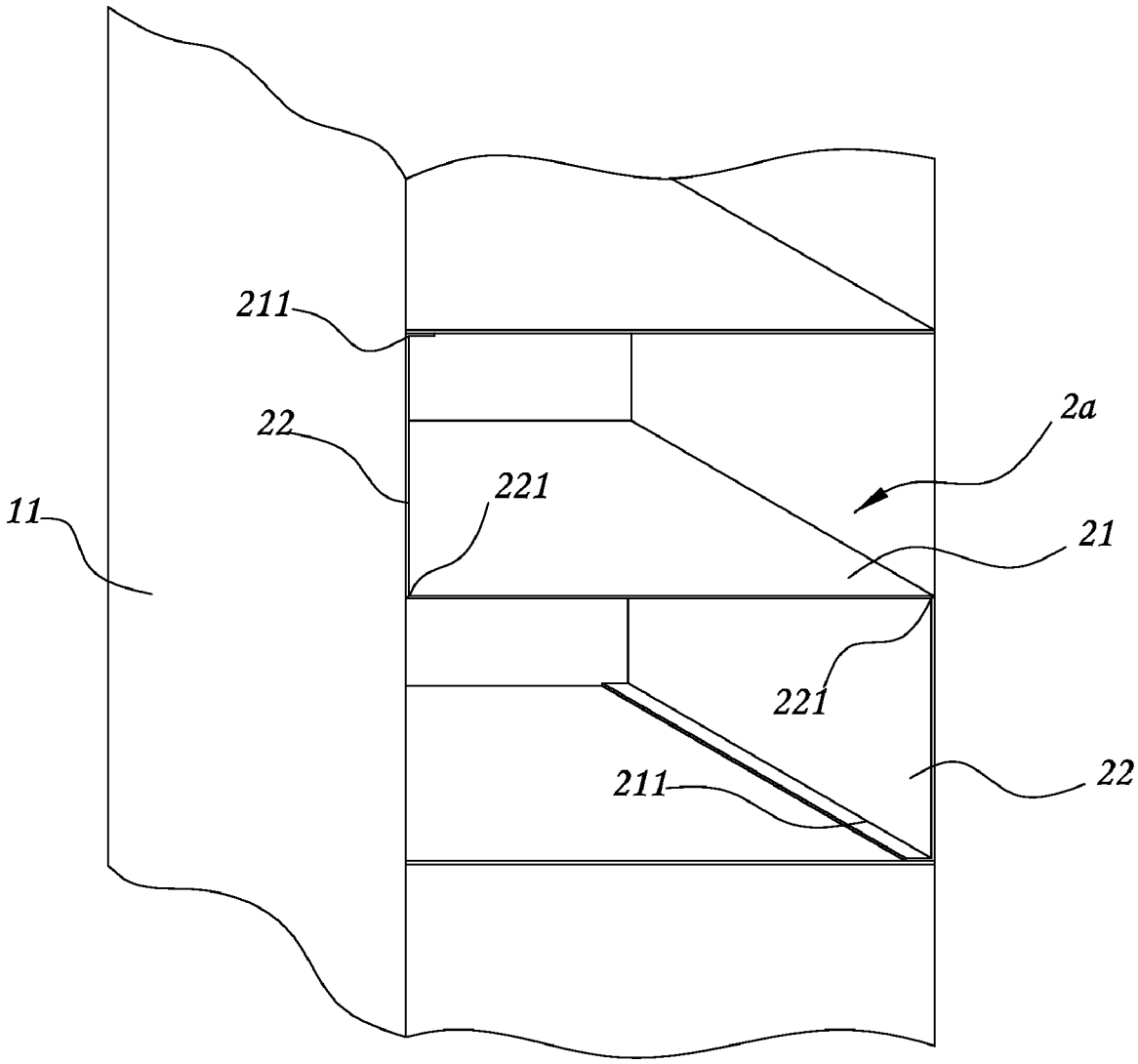
FIG. 7 illustrates one installation example of one ㄴ-shaped partition member in one square receiving space in the shelf of the closet organizer according to the present invention.
Figure 8:
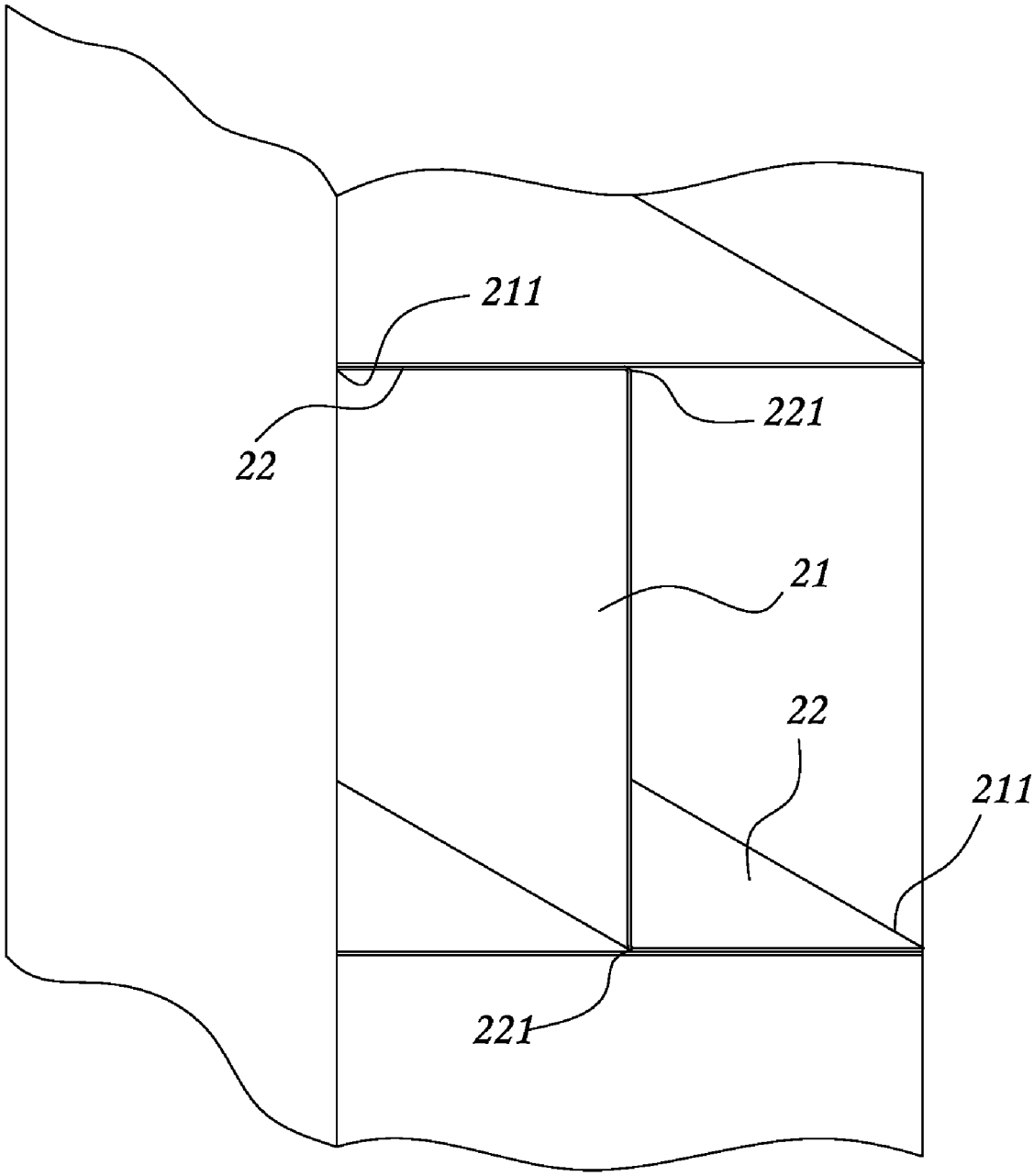
FIG. 8 illustrates another installation example of one ㄴ-shaped partition member in one square receiving space in the shelf of the closet organizer according to the present invention.

When installing one ㄴ-shaped partition member 2*a* of the second form in one square receiving space defined in the shelf 1, it can be done in any of the two ways respectively shown in FIGS. 7 and 8. According to the installation method shown in FIG. 7, the two second fastening devices 23 of the ㄴ-shaped partition member 2 are respectively fastened to one first fastening device 13 at the top side of the horizontal partition panel 12 that is disposed at the bottom side of the rectangular receiving space and one first fastening device 13 at the bottom side of the horizontal partition panel 12 that is disposed at the top side of the square receiving space, and the first and second side boards 22 and 22*a* are respectively attached to the two vertical side panels 11 of the shelf 1 to support the intermediate board 21 in horizontal, thereby dividing the respective square receiving space into two vertically spaced compartments. According to the installation method shown in FIG. 8, the two second fastening devices 23 of the ㄴ-shaped partition member 2 are respectively fastened to one first fastening device 13 at the top side of the horizontal partition panel 12 that is disposed at the bottom side of the square receiving space and one first fastening device 13 at the bottom side of the horizontal partition panel 12 that is disposed at the top side of the square receiving space, the two side boards 22 are respectively closed attached to the bottom side of the horizontal partition panel 12 that is disposed at the top side of the square receiving space and the top side of the horizontal partition panel 12 that is disposed at the bottom side of the square receiving space, and the intermediate board 21 is vertically stopped between the two horizontal partition panels 12 at the top and bottom sides of the square receiving space to divide the square receiving space into two equal compartments that are disposed side by side.

Figure 9:
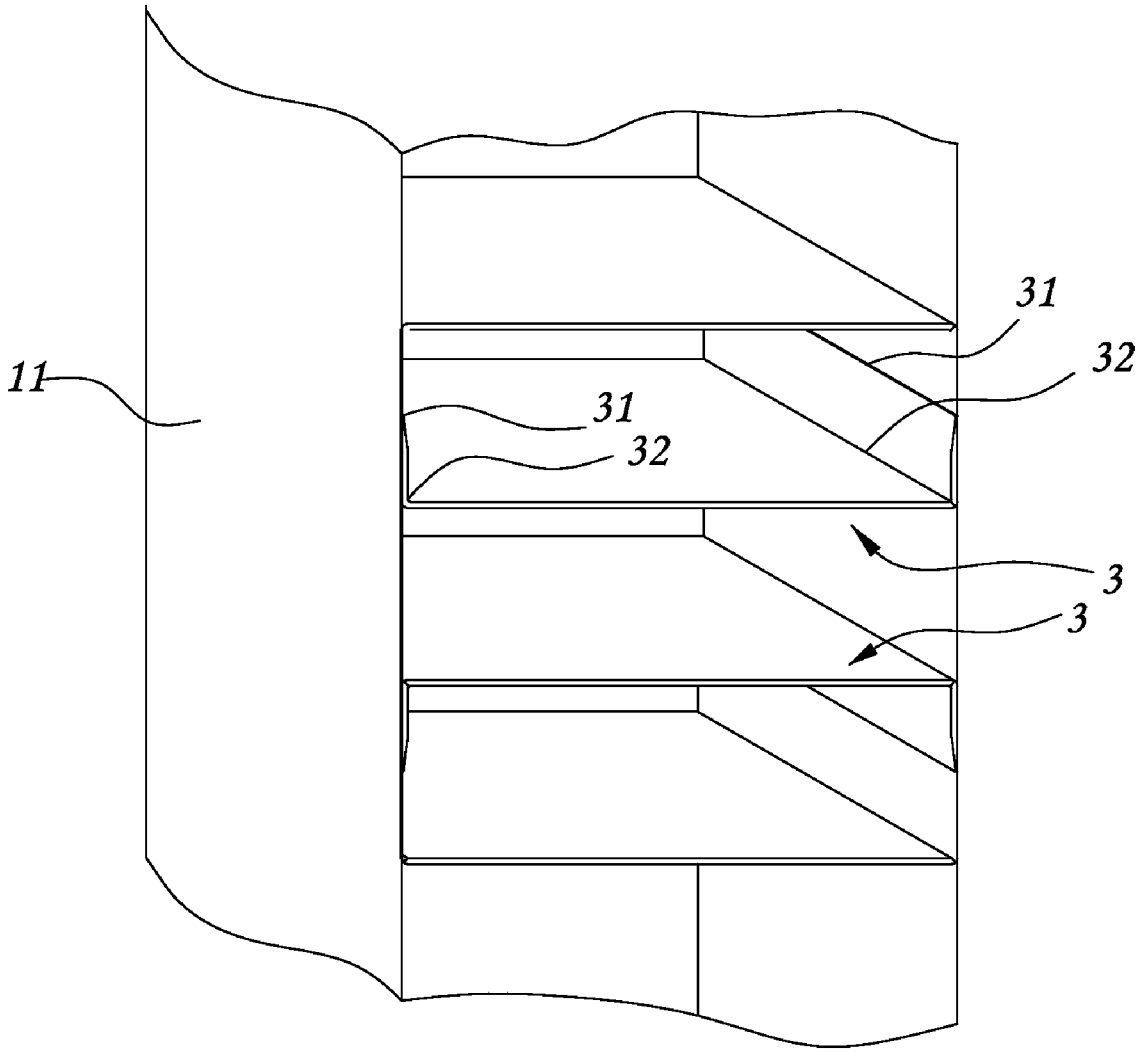
FIG. 9 illustrates two ㄱ-shaped partition members reversely horizontally mounted in one receiving space between two horizontal partition panels of the shelf of the closet organizer according to the present invention.
Figure 10:
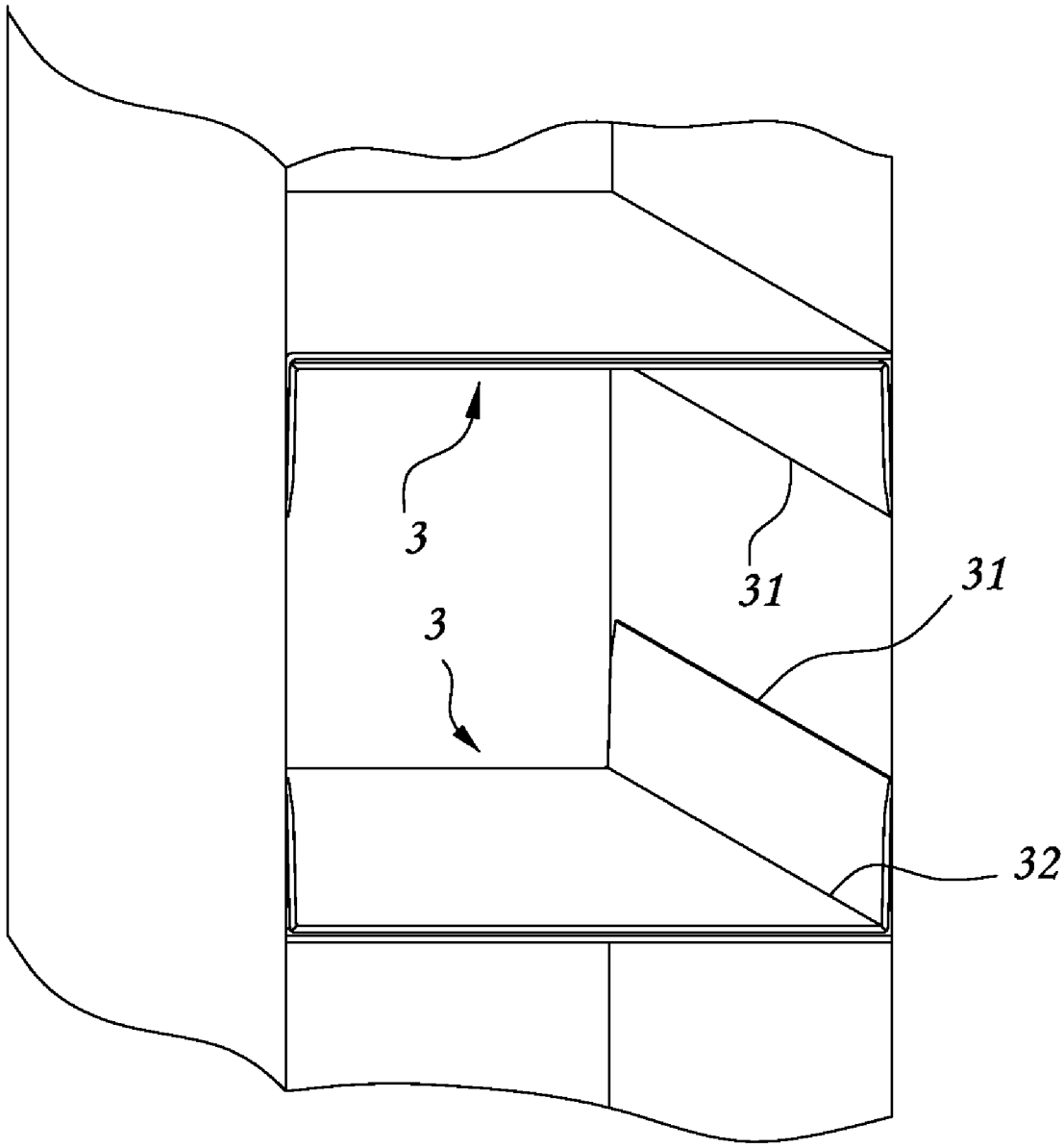
FIG. 10 corresponds to FIG. 9, showing the two ㄱ-shaped partition members respectively closely attached to the two horizontal partition panels at the top and bottom sides of the receiving space in the shelf of the closet organizer according to the present invention.

Referring to FIG. 9, two ㄱ-shaped partition members 3 may be reversely horizontally mounted in each receiving space defined between two horizontal partition panels of the shelf with the two side walls 31 of each ㄱ-shaped partition member 3 respectively attached to the two vertical side panels of the shelf, dividing the receiving space into three vertically spaced compartments. By means of the respective folding lines 32 of the ㄱ-shaped partition members 3, the ㄱ-shaped partition members 3 can be turned in the reversed directions and respectively attached to the two horizontal partition panels at the top and bottom sides of the receiving space (see FIG. 10), allowing the closet organizer to be collapsed.

Figure 11:
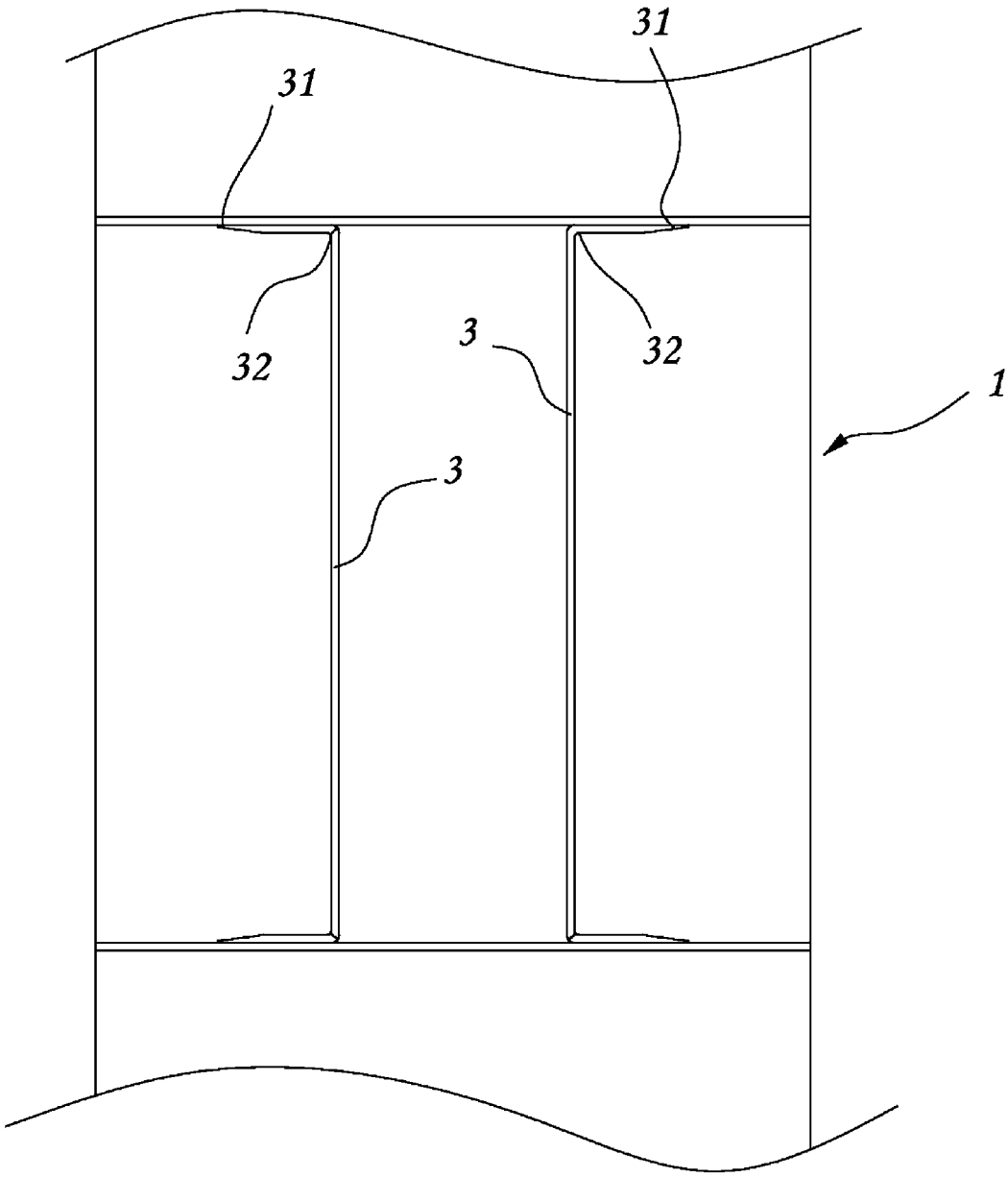
FIG. 11 illustrates two ㄱ-shaped partition members reversely vertically mounted in one receiving space between two horizontal partition panels in the shelf of the closet organizer according to the present invention.
Figure 12:
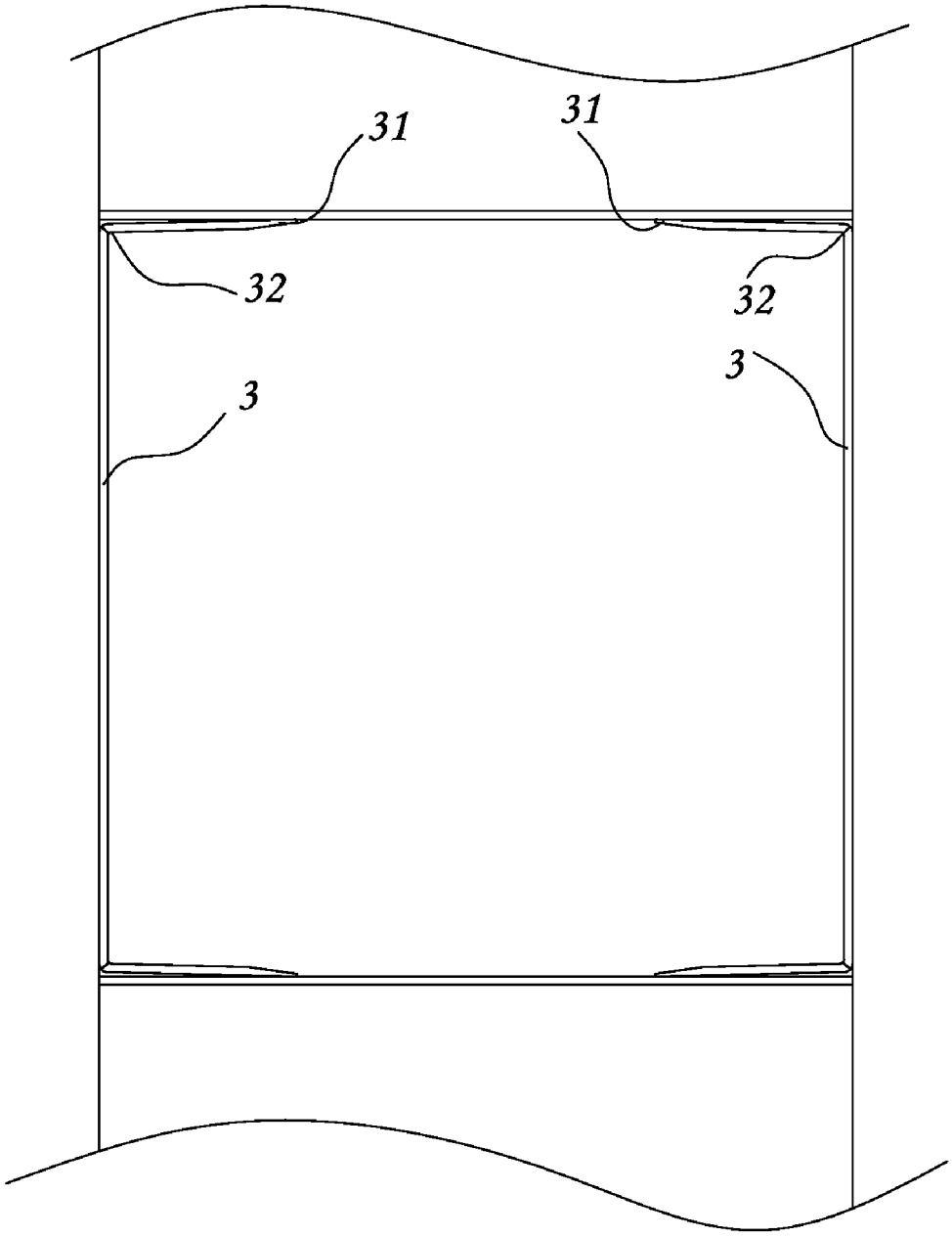
FIG. 12 corresponds to FIG. 11, showing the two ㄱ-shaped partition members respectively closely attached to the two vertical side panels the shelf of the closet organizer according to the present invention.

Referring to FIG. 11, two ⊓-shaped partition members 3 may be reversely vertically mounted in each receiving space defined between two horizontal partition panels of the shelf with the two side walls 31 respectively attached to the two horizontal partition panels at the top and bottom side of one receiving space in the shelf, dividing the receiving space into three compartments that are disposed side by side. By means of the respective folding lines 32 of the ⊓-shaped partition members 3, the ⊓-shaped partition members 3 can be turned in the reversed directions and respectively attached to the two side panels at the shelf (see FIG. 12), allowing the closet organizer to be collapsed.

Figure 13:
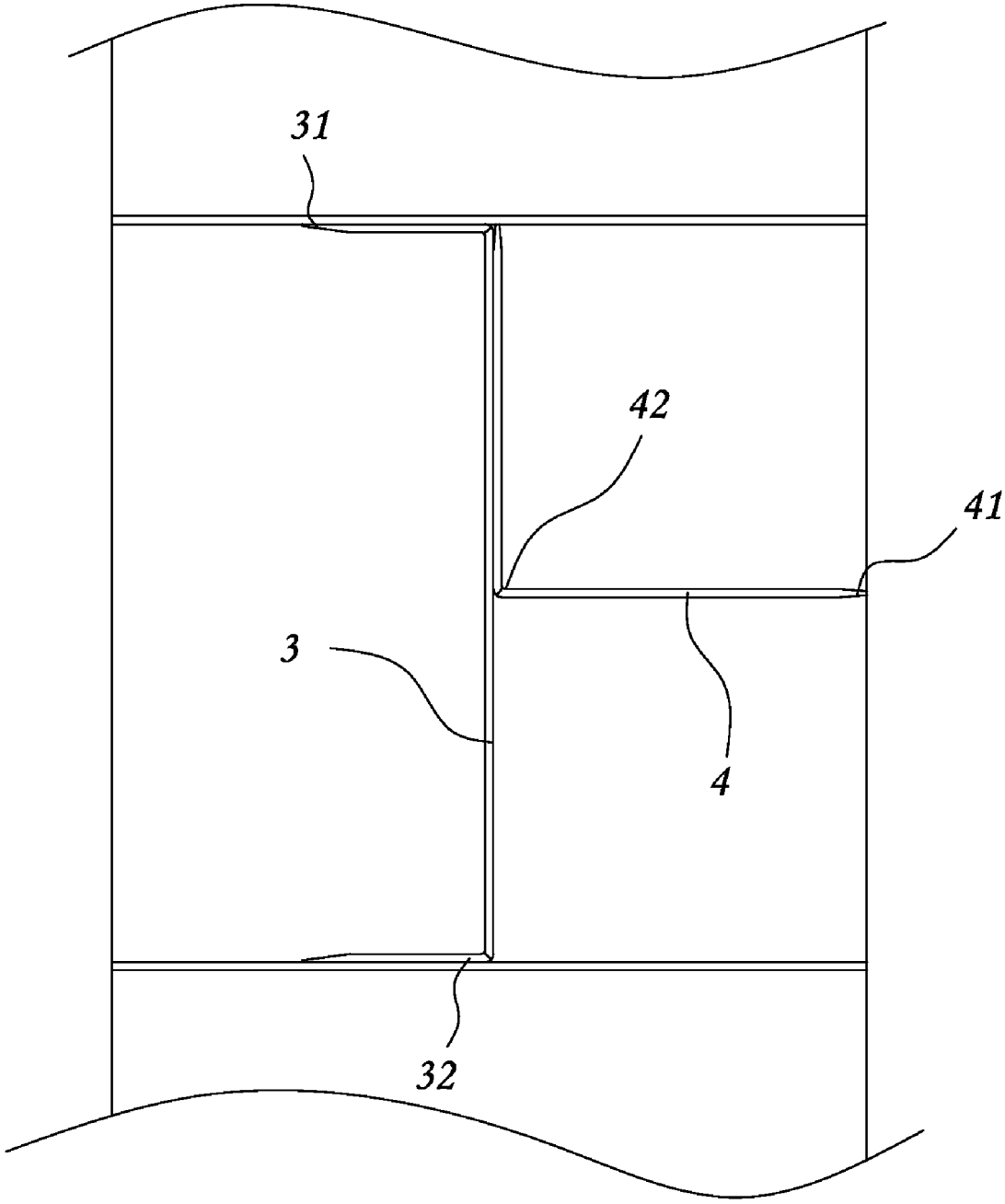
FIG. 13 illustrates one ㄱ-shaped partition member and one L-shaped partition member mounted in one receiving space between two horizontal partition panels in the shelf of the closet organizer according to the present invention.
Figure 14:
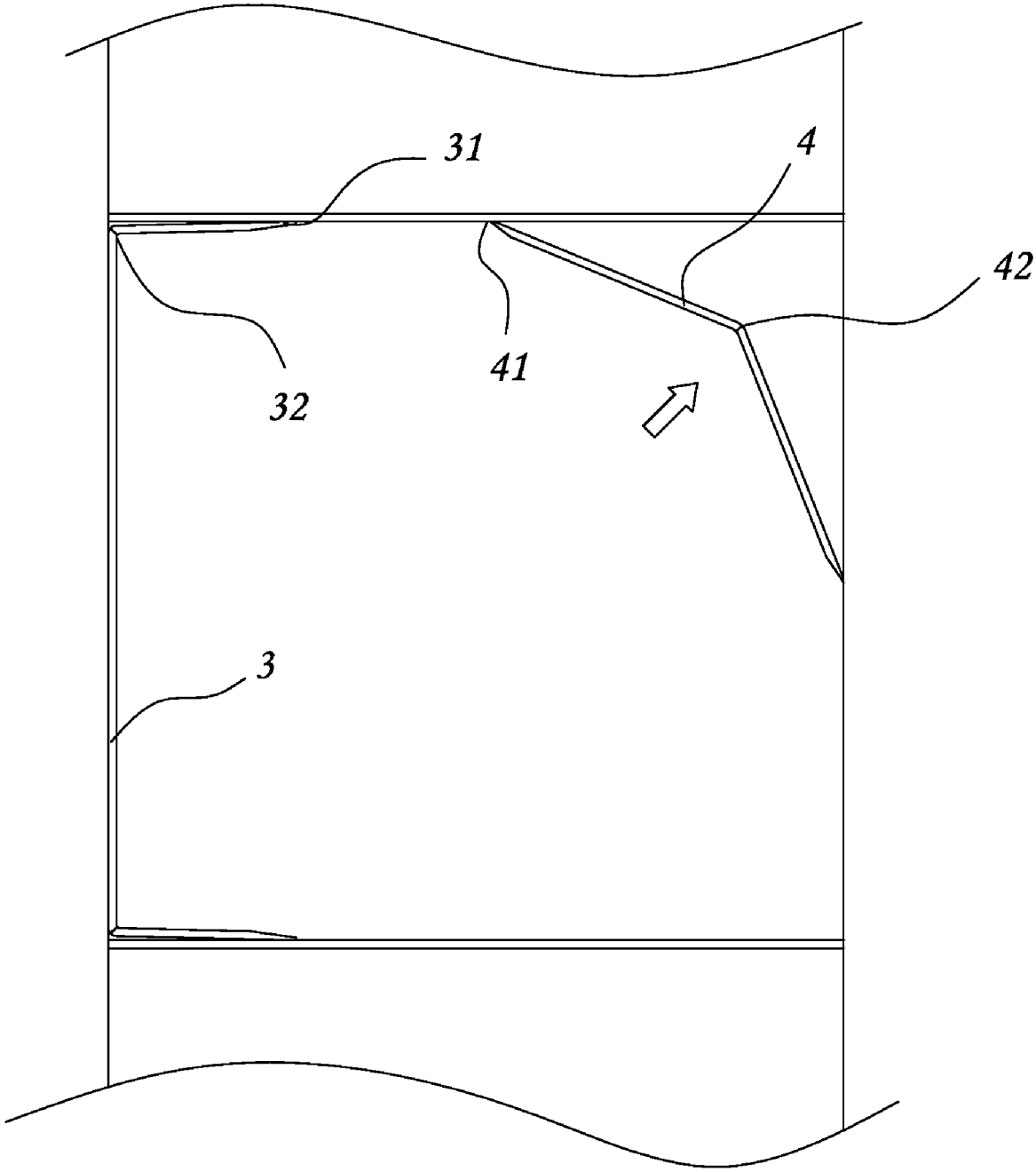
FIG. 14 corresponds to FIG. 13, showing the ㄱ-shaped partition member and the L-shaped partition member moved toward the collapsed position.
Figure 15:
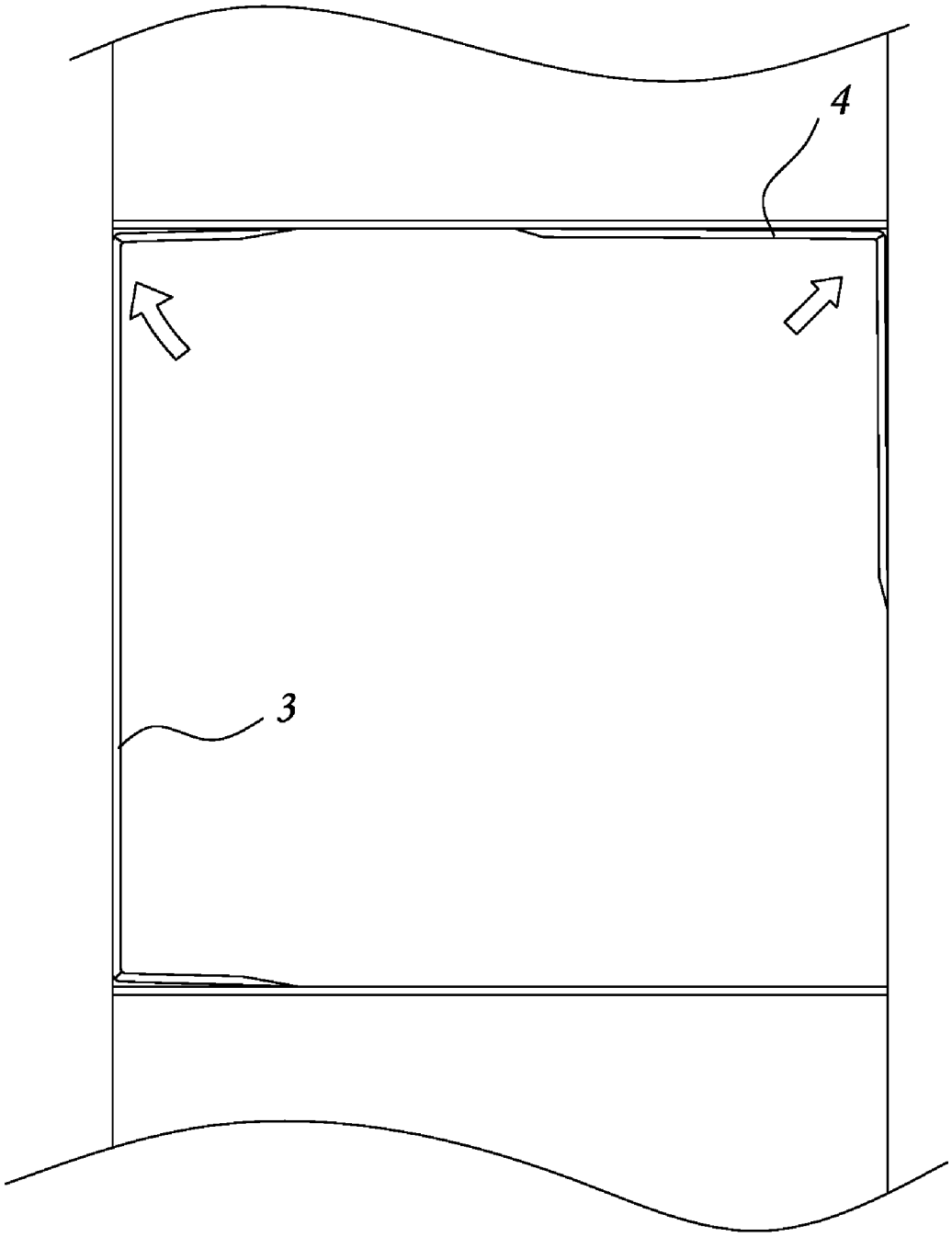
FIG. 15 corresponds to FIG. 14, showing the ㄱ-shaped partition member and the L-shaped partition member collapsed and closely attached to the two vertical side panels of the shelf and the two horizontal partition panels at the top and bottom side of the receiving space in the shelf of the closet organizer according to the present invention.

Referring to FIG. 13, one L-shaped partition member 4, which comprises two boards 41 and a folding line 42 connected between the two boards 41, and one ⊓-shaped partition member 3 may be mounted in one receiving space defined between two horizontal partition panels of the shelf with the two side walls 31 of the ⊓-shaped partition member 3 respectively attached to the two horizontal partition panels at the top and bottom side of one receiving space in the shelf and with one of the two boards 41 of the L-shaped partition member 4 closely attached to the ⊓-shaped partition member 3 and the other of the two boards 41 of the L-shaped partition member 4 stopped between he ⊓-shaped partition member 3 and one vertical side panel of the shelf, dividing the receiving space into three compartments. By means of the respective folding lines 32 of the ⊓-shaped partition members 3 and the folding line 42 of the L-shaped partition member 4, the ⊓-shaped partition member 3 can be turned sideways and closely attached to one vertical side panel of the shelf and the two boards 41 of the L-shaped partition member 4 can be respectively closely attached to one vertical side panel of the shelf and the horizontal partition panel at the top side of the receiving space (see FIGS. 14 and 15), allowing the closet organizer to be collapsed.

Figure 16:
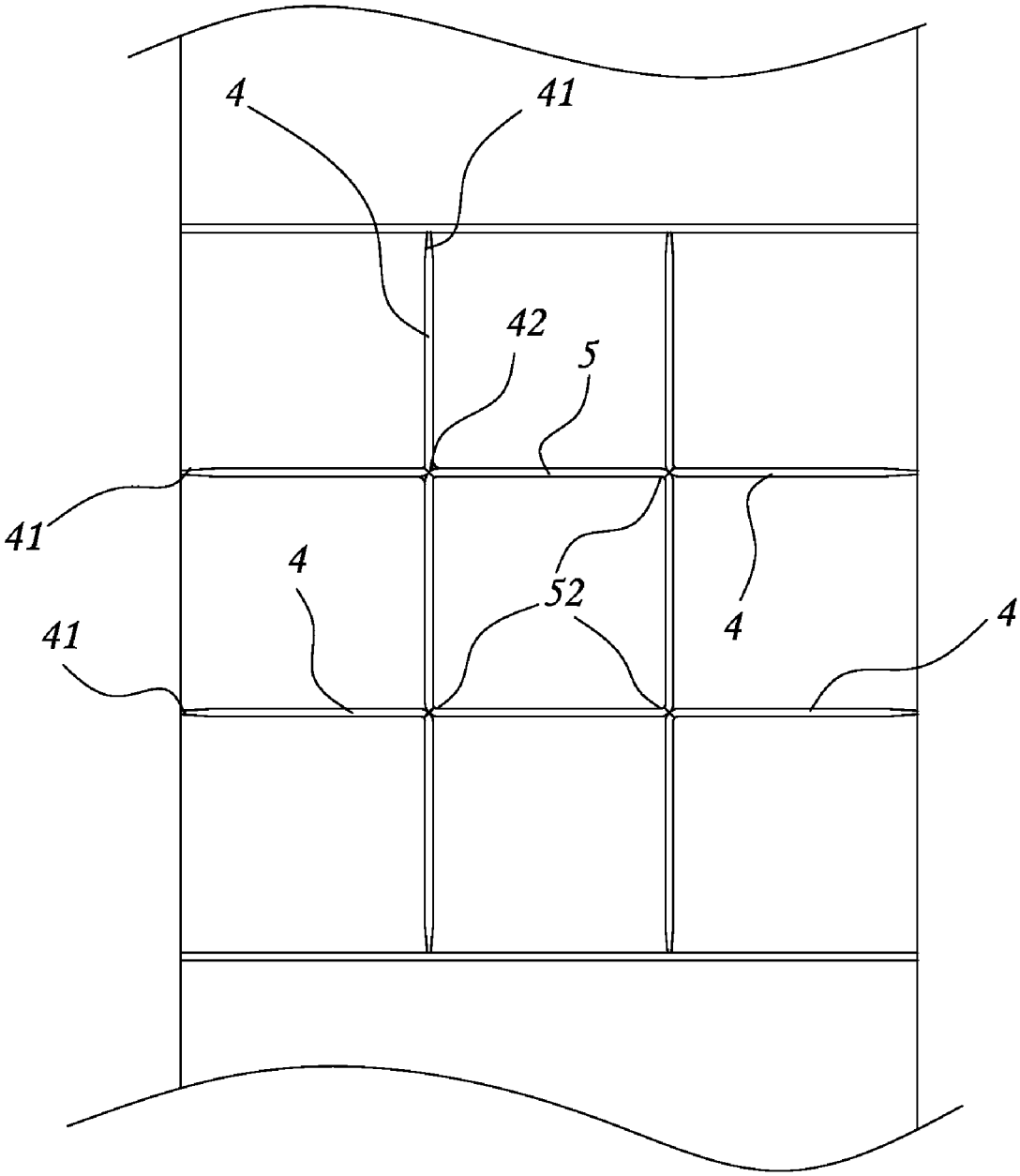
FIG. 16 illustrates four L-shaped partition members and one rectangular box-like partition member mounted in one receiving space between two vertically spaced horizontal partition panels in the shelf of the closet organizer according to the present invention.
Figure 17:
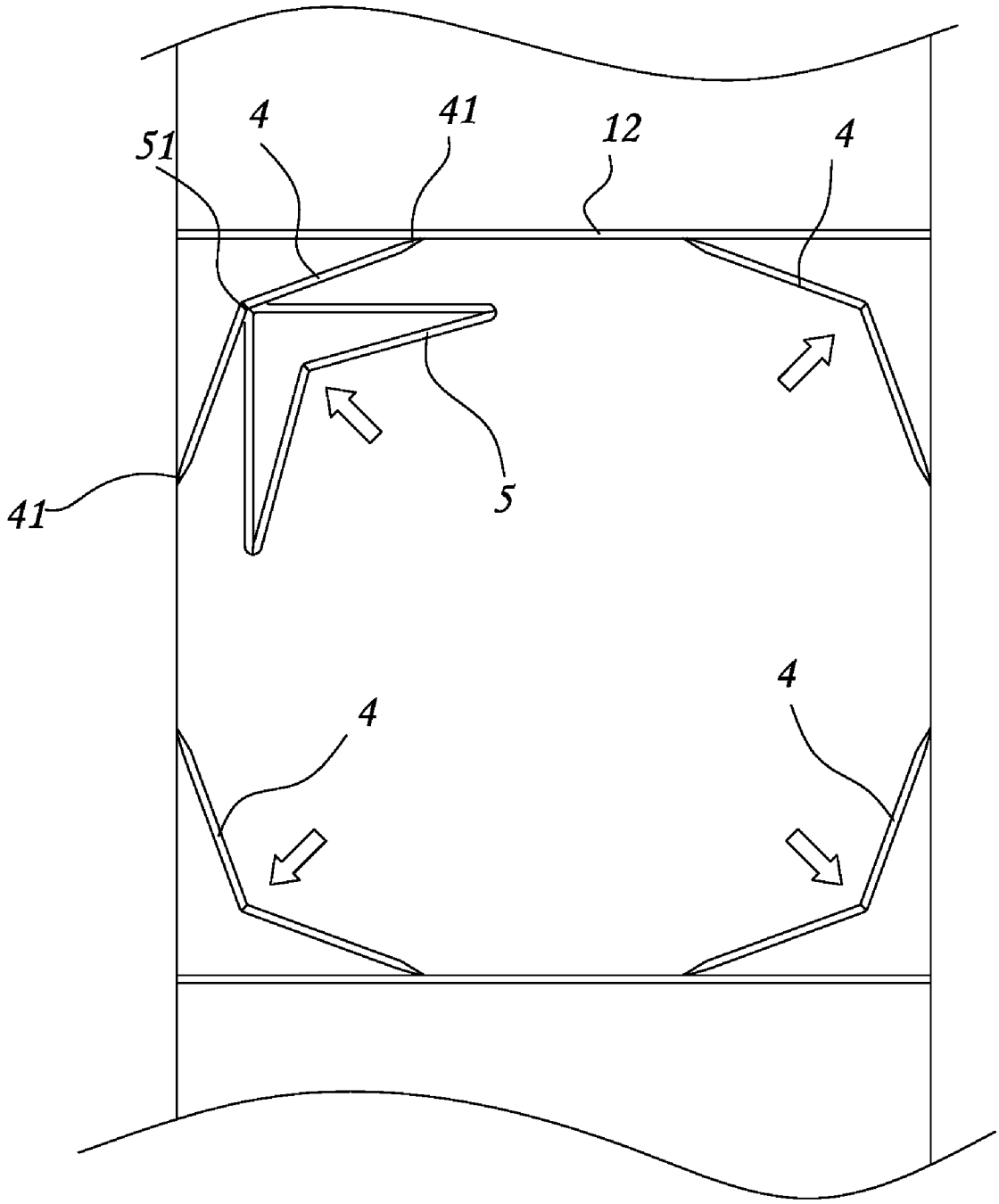
FIG. 17 corresponds to FIG. 16, showing the L-shaped partition members and one rectangular box-like partition member moved toward the collapsed position.

Referring to FIG. 16, four L-shaped partition members 4 and one rectangular box-like partition member 5, which has its four sides 51 respectively connected to one another by a respective folding line (hinge) 52, are mounted in one receiving space defined between two horizontal partition panels of the shelf, dividing the receiving space into 9 horizontally vertically aligned compartments. The four L-shaped partition members 4 are respectively mounted in the four corners inside the receiving space in the shelf with the respective two boards 41 respectively perpendicularly stopped against one vertical side panel of the shelf and the horizontal partition panel at the top or bottom side of the receiving space, and the rectangular box-like partition member 5 is mounted in receiving space in the shelf at the center with the four folding lines 52 respectively abutted against the folding lines 42 of the four L-shaped partition members 4. By means of the respective folding lines 42 of the L-shaped partition member 4 and the four folding lines 52 of the rectangular box-like partition member 5, the boards 41 of the L-shaped partition member 4 can be respectively turned outwards and closely attached to the horizontal partition panel at the top or bottom side of the receiving space and one vertical side panel of the shelf and the rectangular box-like partition member 5 can be collapsed and closely secured to one L-shaped partition member (see FIG. 17), allowing the closet organizer to be collapsed.

A prototype of closet organizer has been constructed with the features of FIGS. 1~17. The closet organizer functions smoothly to provide all of the features disclosed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A closet organizer comprising:

a shelf comprising two vertical side panels arranged in parallel at two opposite lateral sides of said shelf, a vertical back panel connected between said side panels at a back side of said shelf, a plurality of horizontal partition panels fixedly connected between said two vertical side panels at different elevations and dividing a holding space surrounded by said two vertical side panels and said vertical back panel into multiple vertically spaced rectangular receiving spaces, and a horizontal hanging hole disposed at a top side for coupling to a hanging rod, said vertical side panels, said horizontal partition panels and said vertical back panel being made of flexible fabrics and fixedly fastened together with stitches, first fastening devices respectively provided at top and bottom sides of each of said horizontal partition panels of said shelf at selected locations; and a plurality of partition members for installation in said rectangular receiving spaces in said shelf to divide each of said receiving spaces into a plurality of compartments, each of said partition members comprising a first side board, a second side board, an intermediate board, two first folding lines respectively connected to said intermediate board between said first side board and said second side board, two opposite side edges of two connection flanges respectively extending from free ends of said first side board and said second side board remote from said intermediate board, a second folding line formed in said second side board in parallel to said first folding lines, second fastening devices respectively provided at said connection flanges and detachably fastened to said first fastening devices, a distance between said second folding line and said first folding line in between said intermediate board and said first side board being equal to a length of each long side of each of said rectangular receiving spaces, and the distance between said two first folding lines being equal to a length of each short side of each of said rectangular receiving spaces;

wherein hook and loop materials are respectively fastened to one of said first fastening devices at a top side of said horizontal partition panel that is disposed at a bottom side of said rectangular receiving spaces and one of said first fastening devices at a bottom side of said horizontal partition panel that is disposed at a top side of said rectangular receiving spaces, said first side board is attached to a top side of said horizontal partition panel that is disposed at a bottom side of said rectangular receiving spaces, said intermediate board is obliquely stopped between said horizontal partition panel that is disposed at a bottom side of said rectangular receiving spaces and one of said side panels of said shelf, and said second side board is kept in a double-beveled condition and suspending in said rectangular receiving spaces, and therefore said partition member divides said rectangular receiving spaces into three different sizes of compartments.

* * * * *